United States Patent [19]

Brackmann et al.

[11] Patent Number: 4,754,765

[45] Date of Patent: Jul. 5, 1988

[54] HOPPERLESS CIGARETTE MAKING MACHINES

[75] Inventors: Warren A. Brackmann; Stanislav M. Snaidr, both of Mississauga; Takeshi Nehyo, Willowdale; Michael H. Sheahan, Toronto, all of Canada

[73] Assignee: Rothmans of Pall Mall Limited, Toronto, Canada

[21] Appl. No.: 863,009

[22] Filed: May 14, 1986

[30] Foreign Application Priority Data

May 15, 1985 [GB] United Kingdom ..... 8512292
May 15, 1985 [GB] United Kingdom ..... 8512293
Jul. 25, 1985 [GB] United Kingdom ..... 8518782

[51] Int. Cl.[4] ..... A24C 5/14

[52] U.S. Cl. ..... 131/109.1; 131/84.1

[58] Field of Search ..... 131/108, 109.1, 109.2, 131/110, 84.1, 84.2, 84.3, 84.4

[56] References Cited

U.S. PATENT DOCUMENTS 4,463,767 8/1984 Seragnoli ..... 131/109.1

*Primary Examiner*—V. Millin
*Attorney, Agent, or Firm*—Sim & McBurney

[57] ABSTRACT

The quality of a tobacco filler rod as formed in cigarette-making machines is improved. The improvement is achieved by by-passing all the metering and refusing mechanisms of a conventional cigarette-making machine and providing a wide carpet of opened tobacco particles directly to the filler rod-forming procedure.

20 Claims, 6 Drawing Sheets

HOPPERLESS CIGARETTE MAKING MACHINES

FIELD OF INVENTION

The present invention relates to cigarette-making machines, in particular, to mechanisms and procedures for forming feed streams therein.

BACKGROUND TO THE INVENTION

In the conventional manufacture of cigarettes, a tobacco filler rod is formed by moving an air-permeable collecting surface transverse to a vertically-moving thin shower of tobacco, collecting the tobacco thereon to build up a tobacco filler rod across the width of the shower, and wrapping a paper web around the tobacco filler rod. In general, two systems are in commercial use, one wherein the vertically-moving thin shower passes upwardly into engagement with the collecting tape and the other wherein the shower falls downwardly onto the collecting tape.

Upstream of the location of the vertically-moving thin shower a variety of structures and operations have been adopted to form a wide stream or carpet of tobacco from which the shower is formed. Cut tobacco is received by the cigarette-making machine onto a hopper and tobacco is manipulated within the machine by a variety of procedures to form the aforementioned wide carpet. In each of these procedures some form of metering of tobacco occurs, often combined with internal recycle of tobacco, which causes degradation of the tobacco and impairing of filling power. In addition, tobacco often is provided to the hopper in a somewhat unopened form as a result of the procedures used to convey tobacco from cutting operations to the cigarette-making machine, so that the metering operations often lead to further degradation of the tobacco.

In U.S. Pat. No. 4,459,999, assigned to the assignee herein, the disclosure of which is incorporated herein by reference, there is described a cigarette-making operation wherein a reservoir of tobacco is metered and opened to form a tobacco feed stream from which a filler rod is directly formed.

SUMMARY OF INVENTION

The present invention is directed to improvements in conventional cigarette-making machine operations which eliminate internal hoppers and refuser mechanisms and which avoid any necessity for the tobacco to be recycled within the machine, other than any trimmed tobacco, thereby avoiding degradation of tobacco within the machine and loss of filling power.

In one embodiment, the present invention provides a retrofit kit which is universally applicable to any currently-existing cigarette-making machine and which can by-pass the hopper and associated structures and functions. As noted earlier, a common feature of existing cigarette making machines is the formation of a wide carpet of tobacco from which the vertically-flowing shower is formed. The retrofit kit provides the feed of tobacco to the wide carpet of tobacco.

As further described herein, in another embodiment, the modifications of the present invention are effected on the upstream side of carding drum arrangements, which conventionally act as refuser rollers to provide a metered tobacco flow downstream thereof from an overfeed upstream thereof. In this embodiment of the invention, however, the carding drums are operated merely as transporting and not as metering devices, the metering being effected upstream of the carding drums in accordance with the present invention. In an alternative form of this embodiment, the carding drums or other refuser or similar mechanism may be positioned so as to sense and open only tobacco requiring opening, usually in the form of clumps, while the remainder of the tobacco is unaffected. In this way, the tobacco may be redistributed or scattered to average out the "shadows" or thin spots which typically follow tobacco clumps, thereby decreasing the degree of trimming of tobacco which is required.

The present invention enables the construction and operation of existing cigarette-making machines to be improved and simplified and the principles thereof may be incorporated into new machine designs. The present invention results in the production of cigarette filler rods of improved quality with decreased degradation of tobacco.

GENERAL DESCRIPTION OF INVENTION

Figure 1:
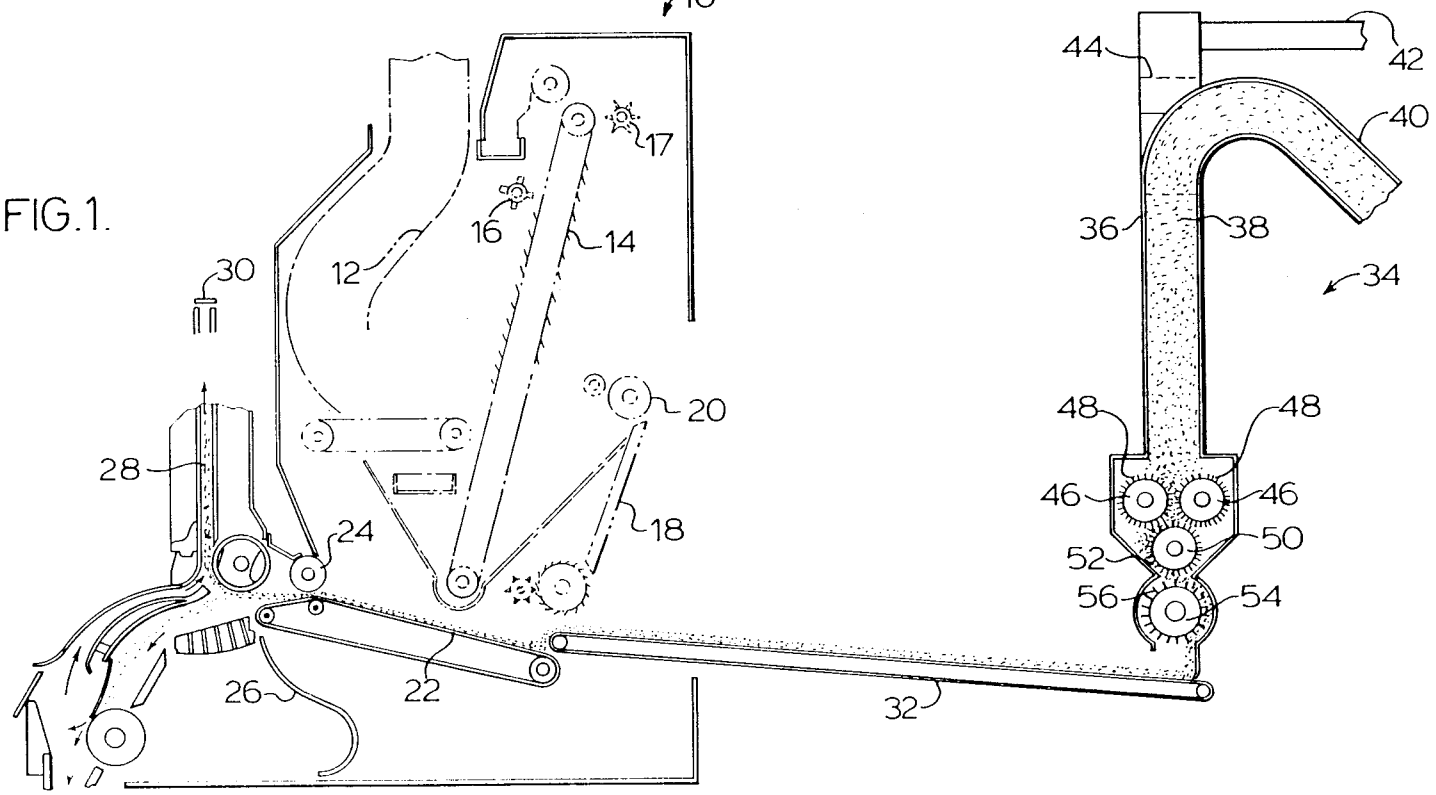
FIG. 1 is a schematic representation of a Molins Mark X cigarette-making machine modified in accordance with one embodiment of the invention.

In the present invention, tobacco is metered from a source of tobacco contained in a reservoir, the metered tobacco is opened to separate the tobacco particles one from another, and the opened tobacco is transported as a wide carpet of opened tobacco particles to the shower-forming operation while maintained in their opened condition. The quantity of tobacco forming the wide tobacco carpet from which the filler rod utimately is formed is controlled by the rate of metering from the reservoir, so that no refuser roll or additional metering means is required at a downstream location.

The reservoir preferably comprises an upright housing of rectangular cross-section which receives tobacco through an open top thereof to provide a mass of tobacco therein. The metering of tobacco from this mass is effected using a pair of counterrotating rollers located at the bottom of the housing on parallel axes and which have radial pins projecting therefrom which interact to grip tobacco therebetween and provide a downward metered flow from the tobacco mass contained in the reservoir, at a rate corresponding to the rate of rotation of the rollers. Opening of the metered flow of tobacco particles is effected using a third roller located below the counterrotating rollers on an axis parallel to and substantially equidistantly from the axes of the pair of rollers. The third roller has pins which project from the surface thereof to interdigitate with those of the counterrotating rollers. The interaction of the pins in this way results in separation of the metered flow of tobacco particles one from another with a minimum of damage thereto and the formation thereby of an opened mass of tobacco particles. The reservoir may be considered to be a "flow-through" hopper, in which all tobacco fed thereto is used in rod formation.

As the particles are discharged from the third roller, they are received as a wide carpet of tobacco on a moving conveyor surface for transportation to the shower-forming operation of the cigarette-making machine hopper, so that the particles remain in an opened condition in the wide carpet of tobacco and reach the shower-forming operation in this condition.

The manner of effecting the shower-forming operation within the cigarette-making machine depends on the specific machine-type to which the invention is being applied. Typically, such shower-forming operation involves transportation of a wide carpet of tobacco and removal of the individual tobacco particles of the carpet from the end of the transportation device, often under the influence of air, to form the tobacco particle shower, either in an upwardly-flowing or in a downwardly-flowing direction.

In the present invention, the wide carpet of opened tobacco particles which is provided on the moving conveyor surface is transferred to the transportation device of the shower-forming operation to provide the wide carpet of tobacco thereon from which the shower is formed.

In this procedure, therefore, the tobacco in the reservoir is metered, opened and transported to shower formation and thence to filler rod formation without any refuser operation or recycle of tobacco, thereby avoiding the tobacco degradation that occurs in conventional cigarette-making machine operations.

When the present invention is utilized as a retrofit modification to existing cigarette-making machine operations, all internal metering and refuser operations of the machine and a metered and opened flow of tobacco particles is delivered to the location of shower formation in the machine. The quality of tobacco which flows to the shower from which the filler rod is formed, therefore, is controlled by metering from the reservoir and not by any internal machine flow control device.

The cut tobacco may be fed to the reservoir thereof by any procedure. For example, tobacco may be transported from a remote source by a flowing air stream drawn under the influence of vacuum and accumulated in a suitable hopper located above the open top of the reservoir. The transporting air flow is shut off from time to time to permit the accumulated tobacco mass to be dumped from the hopper to the reservoir.

Alternatively, a continuous feed of separated tobacco particles may be provided to the reservoir by transportation under the influence of a flowing air stream drawn under the influence of vacuum from a remote location. In this instance, the interior of the reservoir is maintained under a vacuum and a rotary air lock, or similar device, is required to be employed below the third roller, so as to discharge the opened tobacco to the ambient atmospheric pressure without breaking the internal vacuum. The rotary air lock may comprise a large plurality of shallow pockets or compartments, so as to discharge a substantially continuous flow of tobacco onto the conveyor surfaces.

In a further alternative, a rotary air lock may be used in place of the discontinuous discharge hopper at the top of the reservoir, so as to discharge tobacco continuously or discontinuously from the transportation line to the reservoir, which then is maintained at the ambient atmospheric pressure.

In addition, the cut tobacco may be fed manually to the reservoir or by any other convenient means.

In some modern cigarette-making machines, for example, the Molins Mark VIII or Mark IX machine, the manner of machine construction does not readily permit the introduction of the tobacco downstream of the refuser roller arrangement, usually a pair of counter-rotating carding drums. However, this is not a significant drawback, since it is possible to operate the refuser rollers in a "starved" condition, so that no metering function is performed by the rollers but rather they serve only to transport the wide carpet of tobacco, which is introduced upstream of the refuser rollers. The wide carpet of tobacco which is transported by the lower carding drum then is removed therefrom for formation of an upwardly-flowing shower of tobacco particles.

In a modification of this procedure, the refuser rollers may be used to sense and open, by suitable spacing of the carding drums, any residual clumps of tobacco which may remain in the wide carpet of tobacco, (typically less than 1% of the tobacco), with the remainder of the opened tobacco being transported by the refuser rollers.

The tobacco metered from the reservoir and opened to form the wide tobacco carpet transported to the refuser rollers, therefore, is transported by them without degradation thereto, so that the quality of the tobacco is not impaired. Rather, the quality may be improved further by selective opening of the small number of residual clumps of tobacco present in the carpet between the carding drums.

The retrofit apparatus suitable for modification of existing cigarette-making machines, in accordance with the present invention, comprises a supporting frame, an elongate conveyor which is mounted to the frame and which communicates at its downstream end with the location of the shower-forming operation in the cigarette-making machine, and a combined reservoir and metering and opening device also mounted to the frame usually adjacent the upstream end of the conveyor.

The principles which are embodied in the modification of the existing cigarette-making machine structure and operation, enable the provision of a novel form of cigarette-making machine which does not employ refuser mechanisms and which does not employ tobacco recycle, (except for tobacco trimmed from the filler rod). The reservoir of tobacco and associated metering rollers in combination with the opening roller is a simple and compact structure which eliminates all the complex hopper and metering systems used in modern cigarette-making machines and provides the considerable additional benefit that the tobacco degradation associated with conventional systems is avoided.

In a preferred aspect of the present invention, recycled trimmed tobacco is used to control the feed of tobacco to rod formation, as described in copending U.S. patent application Ser. No. 06/862,982 filed May 14, 1986 and entitled "Control of Cigarette Rod Formation", the disclosure of which is incorporated herein by reference. As set forth therein, for the purposes of such control, an upright reservoir vessel is divided laterally into two chambers, one narrow and one wide, recycled trimmed tobacco is fed to a narrow chamber, the height of tobacco in the narrow chamber is sensed, and the flow rate of tobacco from both chambers, as determined by the speed of operation of the metering rollers and the opening roller, which extend across the whole width of the reservoir, is speeded up or slowed down in response to predetermined "too-low" or "too-high" levels in the narrow chamber.

A sensed "too-high" condition indicates that more tobacco is being trimmed from the rod than desired, which, in turn, indicates that too much tobacco is being fed from the reservoir to rod formation. The sensed "too-high" condition then triggers an appropriate slowing down of the tobacco feed rate from the reservoir. Similarly, a sensed "too-low" condition indicates that less tobacco is being trimmed from the rod than desired, which, in turn, indicates that too little tobacco is being fed from the reservoir to rod formation. The sensed "too-low" condition then triggers an appropriate speeding up of the tobacco feed rate from the reservoir.

The recycle of trimmed tobacco to the reservoir in this aspect of the invention is the only recycle of tobacco which occurs in the present invention. Trimming conventionally is effected in filler rod formation to even out the quantity of tobacco in the cross-section of the rod and the trimmed tobacco usually is recycled to the cigarette-maker hopper, to avoid loss of such tobacco, and, in this aspect of the invention, the recycled tobacco is used in a simple yet effective way to control rod formation.

In addition, in this preferred aspect of the invention, it is preferred to recycle the trimmed tobacco and feed the same to the rod-forming operation in such manner that the trimmed tobacco is located on the side of the filler rod which is opposite to that in contact with the rod-forming surface. In this way, an increase in the quantity of "shorts" (i.e. shorter strands of cut tobacco) on that side of the filler rod is achieved, so as to offset the normal concentration of shorts on the rod-forming surface side of the filler rod, thereby achieving greater uniformity in the filler rod in its cross section. In addition, less total degradation of tobacco by trimming results, since the tobacco which is trimmed from the filler rod is largely made up of that previously trimmed.

In copending U.S. patent application Ser. No. 06/862,981 filed May 14, 1986 and entitled "Composite Cigarette", the disclosure of which is incorporated herein by reference, there is described the formation of composite cigarettes comprising a core of lesser quality smoking material and an annulus of higher quality smoking material surrounding and enclosing the core. As described therein, the composite structure may be formed by superimposing layers of the two types of smoking material and then enclosing the resulting filler rod in a paper wrapper.

By the utilization of a reservoir vessel divided into three chambers or by using separate reservoir vessels along with the metering and opening operations described herein, core material and annulus material may be formed into a wide carpet having a central region of core material and outer regions of annulus material, from which the filler rod ultimately is formed.

DESCRIPTION OF PREFERRED EMBODIMENTS

Referring first to FIG. 1, there is illustrated therein the application of the principles of the invention as retrofit to a Molins Mark X cigarette-making machine. As may be seen in FIG. 1, the machine 10 generally comprises a hopper 12 having a first refuser mechanism constituted by a rising conveyor 14 and a refuser roll 16. In the conventional machine, the metered flow of tobacco is picked by picker roll 17 and projected downwardly towards a metering chute 18, the flow to which is controlled by a refuser roller combination 20. From the metering chute 18, the tobacco normally is conveyed by conveyor 22 to a further refuser roll combination 24, before the tobacco is exposed to an upwardly-flowing air stream flowing from guide 26 into a chimney 28. The tobacco is conveyed by this upwardly-flowing air stream into contact with the undersurface of a suction belt 30 moving transversely to the tobacco stream, so as to build up a tobacco filler rod along its length and from which cigarettes may be formed in conventional manner.

In accordance with the present invention, the hopper 12, the metering chute 18 and the associated refuser mechanisms are by-passed, a feed of substantially separated tobacco particles is provided directly to the conveyor 22 by a conveyor 32 which is fed by a tobacco reservoir and metering and opening device 34. The device 34 comprises an upright rectangularly cross-sectioned reservoir tube 36 which holds a reservoir 38 of tobacco for feeding to the conveyor 32 and thence to the hopper 12. The reservoir tube 36 is open at both its upper and lower ends and communicates at its upper end with a feed pipe 40 air conveying cut tobacco from a remote source under the influence of vacuum applied by pipe 42. A suitable transmitter device for such cut tobacco at the remote source is described below with respect to FIGS. 3 and 4. An air-tobacco separator screen 44 is provided within the device 34 to effect tobacco and conveying air separation.

At the lower end, the reservoir tube 36 communicates with a pair of metering rollers 46 which are mounted to rotate on parallel axes and have radially-directed pins 48 to meter a flow of tobacco from the mass 38 contained in the reservoir tube 36. A third roller 50 is positioned to rotate on an axis substantially equidistantly positioned with respect to the axes of the rollers 46. The roller 50 has pins 52 which interdigitate with the pins 48 so as to open the metered flow of tobacco and separate the individual particles one from another.

A rotary air lock 54 serves to discharge the opened tobacco from the vacuum environment to the external atmospheric pressure environment. The air lock 54 is provided with a plurality of radially-directed vanes 56 which define a plurality of shallow pockets which transport the opened tobacco from the roller 50 and discharge it in substantially opened condition as a carpet 58 on the upper surface of the conveyor 32. In this way, the tobacco which is fed to the conveyor 22 is in substantially opened condition and is readily handled in the machine 10.

Figure 3:
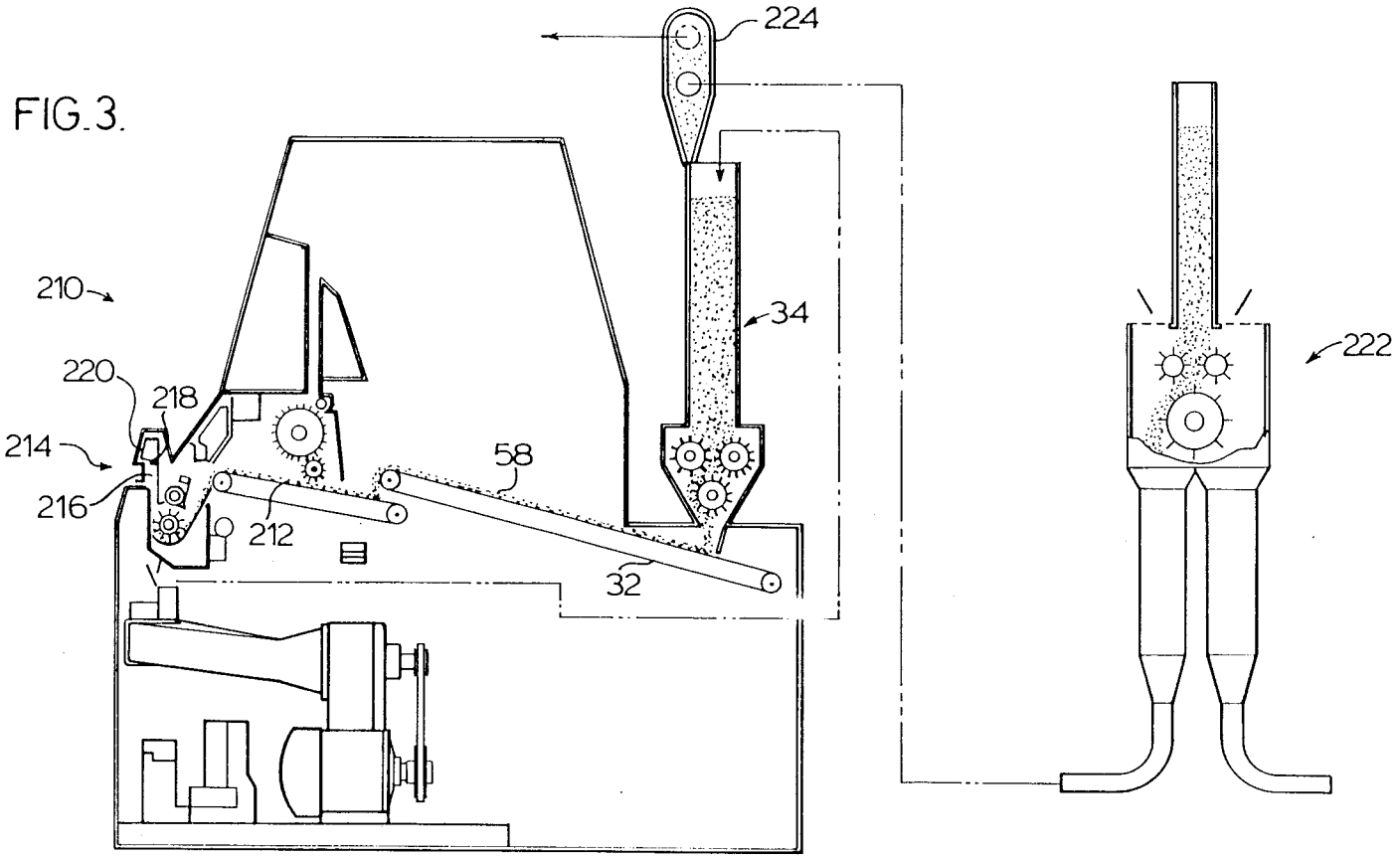
FIG. 3 is a schematic representation of a Hauni Protos cigarette-making machine modified in accordance with a further embodiment of the invention.

Although the device 34 is illustrated as operating with a continuous feed of tobacco by pipe 40 and the provision of a rotating air lock 54, the reservoir tube 36 may be constructed to receive a discontinuous feed of tobacco from a lock hopper, in which case the rotary air lock 54 is not required as seen in FIG. 3 and described below. In addition, the reservoir tube 36 may be fed through a rotary air lock located in fluid flow communication with the top of the tube 36, either intermittently or continuously, or by a conveyor or manually.

The conveyor 32 discharges the carpet 58 of substantially opened tobacco directly onto the conveyor 22, thereby by-passing the hopper 12, the chute 18 and their associated mechanisms. Ideally, the discharge location for the tobacco carpet 58 is at the bottom of the chimney 28 but the structure of the Mark X machine does not readily permit discharge at that location. Instead, in this embodiment, the existing conveyor 22 of the machine is used to transport the tobacco carpet 58 from the conveyor 32 to the bottom of the chimney 28 for formation of the upwardly-flowing tobacco shower from which the filler rod is formed. The quantity of tobacco which is fed onto the conveyor 22 is that quantity required to enter the chimney 28, so that the carding drum 24 acts merely as a transportation device and performs no metering or refuser function.

The embodiment of FIG. 1, therefore, provides a metered feed of opened tobacco directly to the chimney 28 of the cigarette-making machine 10 without utilizing any internal machine metering function and, as a result, the filling power degradation introduced by such internal functions is eliminated.

The combination of the device 34 and the conveyor 32 can be constructed in the form of a retrofit kit to be added on to an existing cigarette-making machine to provide a metered tobacco feed to the desired location within the machine.

Figure 2:
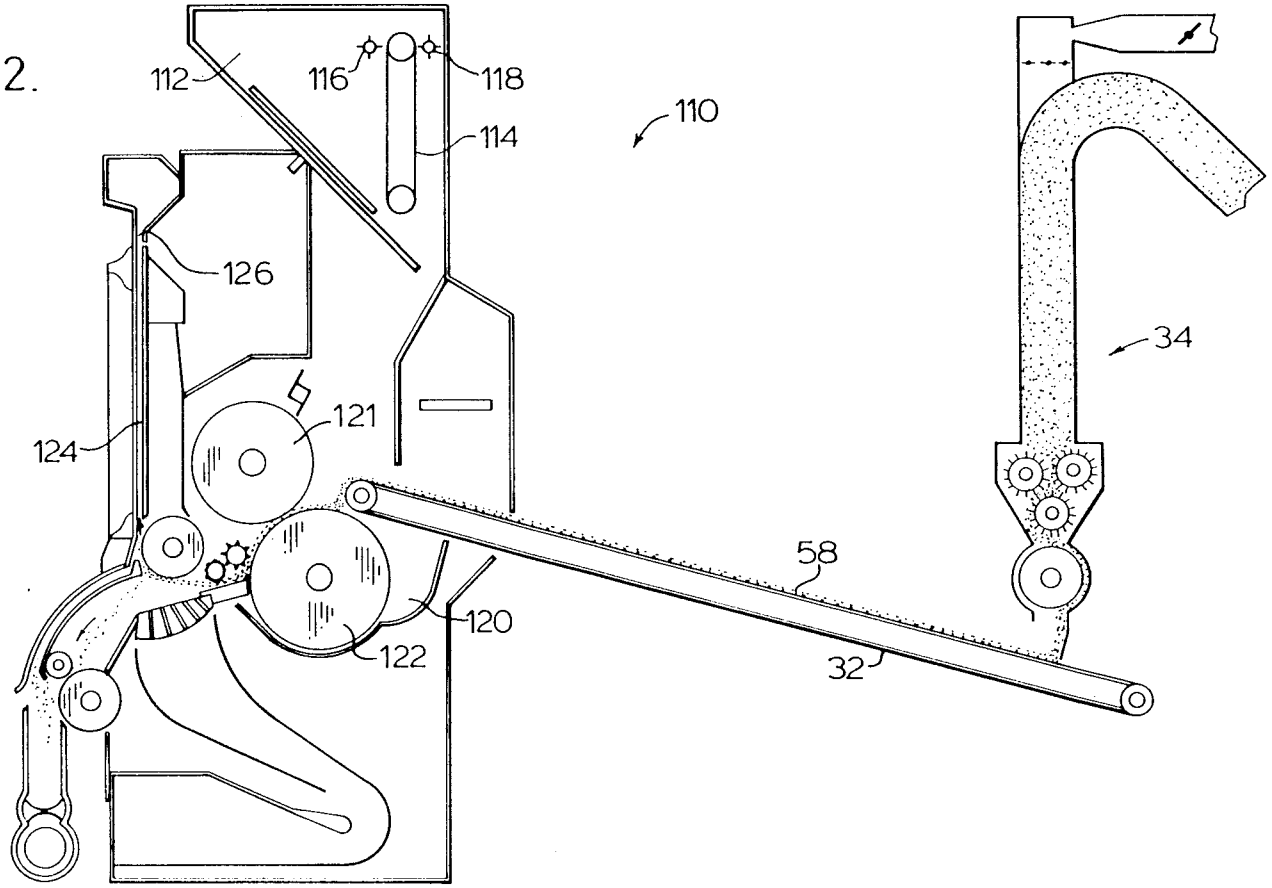
FIG. 2 is a schematic representation of a Molins Mark IX cigarette-making machine modified in accordance with another embodiment of the invention.

Referring to FIG. 2, there is illustrated therein the application of the principles of the invention to a Molins Mark IX cigarette-making machine. As conventionally constructed, the machine 110 comprises a tobacco hopper 112, a tobacco metering conveyor 114 with associated refuser roll 116, a picker roll 118, a collection reservoir 120 for picked tobacco, a pair of carding drums 122 which normally act as a metering/refuser device, an air-flow guide 124, an upwardly-extending chimney 126 and a rod-forming belt 128.

This conventional structure is modified in accordance with the present invention so as to avoid the hopper and refuser operations. As may be seen in FIG. 2, the tobacco carpet 58 is fed directly to and is deposited directly on the surface of the lower of the carding drums 122 and the upper one is positioned so that the carding drums may be operated simply as a transporting device for the tobacco carpet to deliver all the metered flow of opened tobacco constituted by the carpet 58 to the chimney 126, to attain the benefits which flow therefrom. Alternatively, the carding drums 122 may be removed entirely and the carpet 58 then is fed directly to the chimney 126.

As mentioned previously the upper carding drum 122 may be positioned with respect to the lower carding drum so as to engage any lumps of tobacco in the carpet 58 as it is transported on the lower carding drum but not the remainder of the tobacco in the carpet. The upper carding drum engaging any such lump opens the lumps and smooths out the tobacco carpet. Only a few such lumps are present, typically less than 1% of the tobacco, but can cause downstream problems. Their elimination by operation of the refuser carding drum, therefore, is beneficial.

Figure 4:
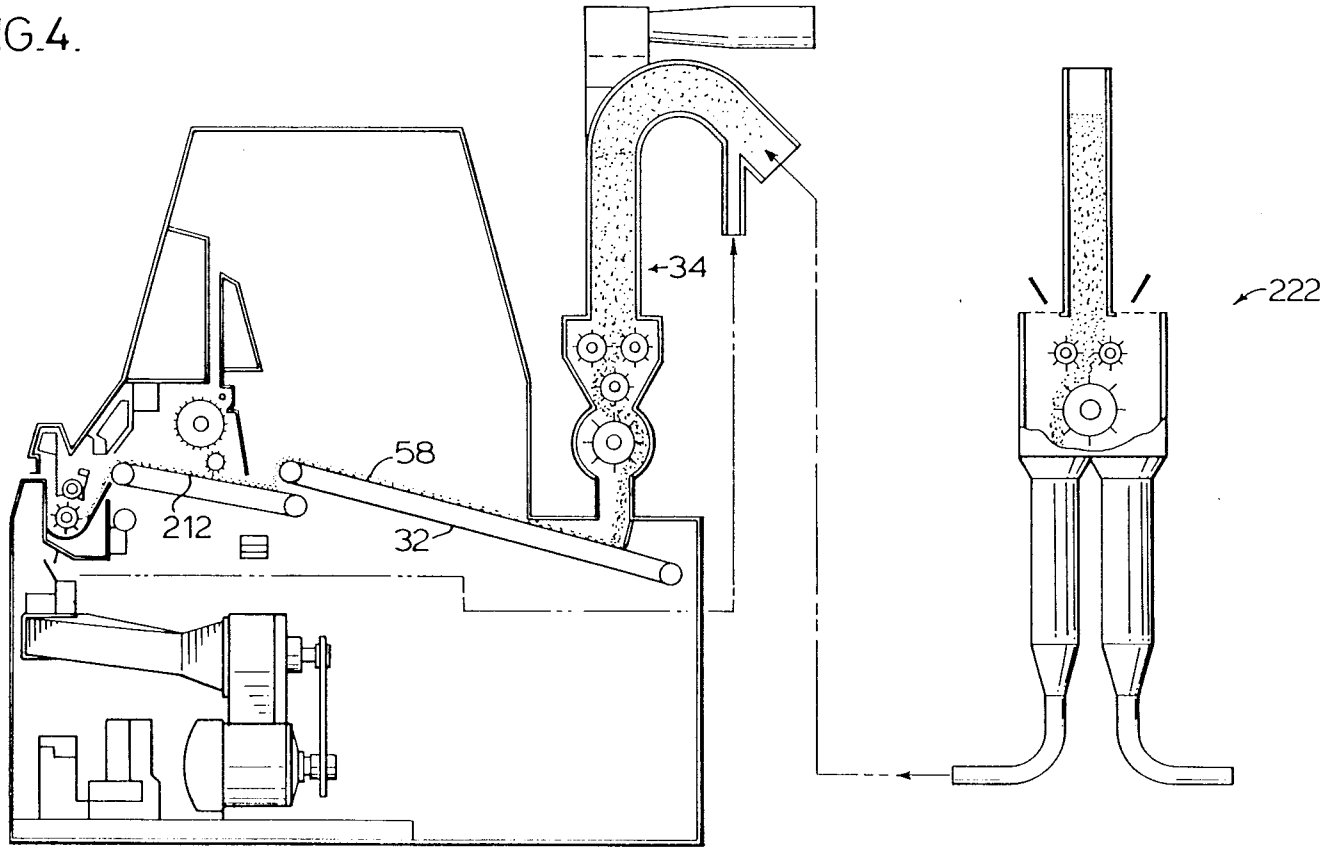
FIG. 4 is a schematic representation of a Hauni Protos cigarette-making machine modified in accordance with an additional embodiment of the invention.

Turning now to FIGS. 3 and 4, there is illustrated therein the application of the principles of the invention to a Hauni "Protos" cigarette-making machine 210. In both FIGS. 3 and 4, the metered flow of opened tobacco constituted by the carpet 58 is fed to an existing conveyor 212 which feeds the tobacco to a shower-forming mechanism 214 which produces an upwardly-flowing shower of tobacco particles in a chimney 216 for deposition on a rod-forming surface 218 through which vacuum is applied by a suction box 220. Feeding the tobacco in this way by-passes the various internal metering and refuser mechanisms, and hence avoids the tobacco degradation produced thereby.

In both embodiments, tobacco for the device 34 is illustrated as provided from a tobacco transmission device 222 remotely located with respect to the cigarette-making machine 210. The transmission device 222 provides a feed of tobacco to two machines, as required by the device 34 at each machine. The transmitter device 222 may form one unit of a feed table device transmitting cut tobacco from tobacco leaf threshing and cutting operations to a plurality of machines, as described in U.S. Pat. No. 4,135,615, assigned to the assignee hereof and the disclosure of which is incorporated herein by reference. The latter U.S. patent also provides details of a suitable transmitter device 222.

In the embodiment of FIG. 3, the receiver device 34 is in the form described above when tobacco is received in the resevoir tube 36 on a discontinuous basis from a hopper device 224 and no rotary air lock 54 is required. In the case of FIG. 4, the tobacco is continuously discharged to the reservoir 34 and a continuous air lock is employed to discharge the opened tobacco to the conveyor 32.

Figure 5:
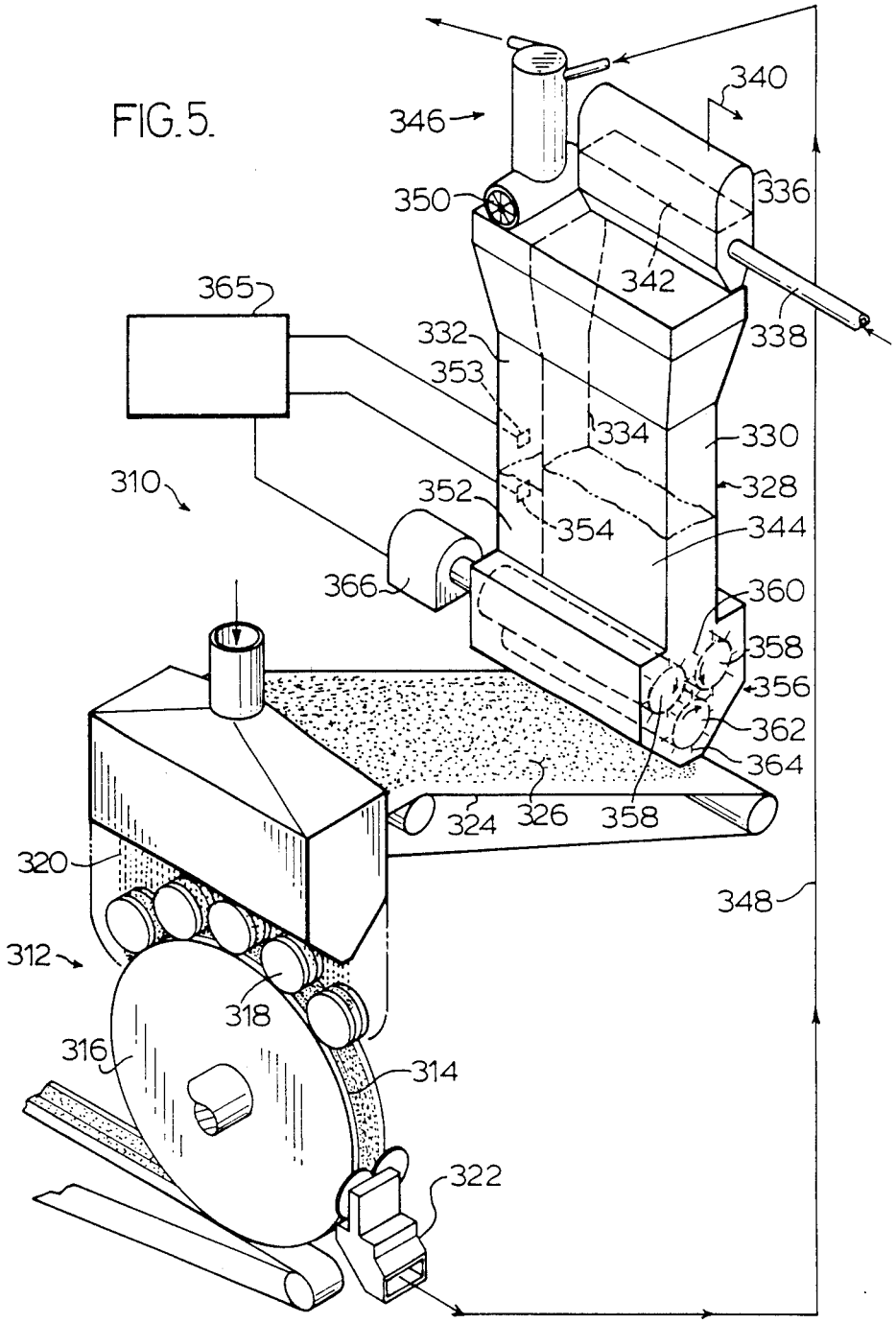
FIG. 5 is a schematic representation of a novel cigarette-making machine including trimmed tobacco recycle control.

Referring now to FIG. 5 of the accompanying drawings, there is illustrated therein a cigarette-making machine 310 constructed in accordance with the principles of the present invention. In the illustrated embodiment, a tobacco feed is provided for a filler rod-forming mechanism 312, wherein a tobacco filler rod 314 is formed from substreams of tobacco by layering of the same one on another on the periphery of a vacuum wheel 316. The substreams are formed on vacuum wheels 318 from a falling stream or shower 320 of separated tobacco particles. The rod-forming mechanism 312 is fully described in U.S. Pat. No. 3,980,088 and reference may be made thereto for details of the construction and operation. The rod-forming mechanism 312 is provided with a trimmer 322 to remove excess tobacco from the rod 314.

While this embodiment of the present invention is illustrated and described with reference to the filler rod-forming mechanism 312, the principles of the manner of formation of the tobacco feed for the rod former and its manner of control are applicable to any rod-forming procedure wherein a tobacco filler rod is formed, directly or indirectly, from a falling or rising stream or shower of substantially-separated tobacco particles, for example, one of the rod-forming operations illustrated in FIGS. 1 to 4.

The falling tobacco shower 320 is formed by permitting tobacco to fall from the end of a conveyor 324 on which is conveyed a thin carpet 326 of opened tobacco particles. A conventional winnowing operation usually is carried out on the thin carpet 326 as the shower 320 is formed to remove heavy tobacco particles. Details of the winnowing have been omitted for clarity.

The tobacco carpet 326 is formed by discharge from a hopper or reservoir device 328 of novel construction. The reservoir device 328 has a generally rectangularly cross-sectioned tobacco receiving zone which is divided internally into two physically-separate chambers 330 and 332 by a baffle 334. The chamber 332 is of relatively narrow width as compared with the chamber 330. The width of the chamber 332 in comparison with that of the chamber 330 determines and controls the degree of trimming of the tobacco rod 314, as will become apparent from the further description below.

A tobacco separation and discharge device 336 is provided at the upper end of the reservoir device 328 in communication with the wide chamber 330 for receiving cut tobacco conveyed through feed pipe 338 by air from the application of vacuum to line 340, for separation of the tobacco from the conveying air by a suitable screen 342 and for feeding charges of tobacco so separated from the conveying air by the screen 342 intermittently into the chamber 330.

The discontinuous discharge device 336 may be replaced, if desired, by a continuous discharge device, whereby tobacco fed by feed pipe 338 is continuously discharged into the chamber 330. For this purpose, the interior of the reservoir device 328 is maintained under vacuum and a continuous air lock is required to be included in the structure of the reservoir device 328 to enable tobacco to be continuously discharged from the reservoir chamber 330 to the external atmospheric conditions without loss of the internal vacuum. One suitable structure is illustrated in U.S. Pat. No. 4,446,876 and reference may be had thereto for details of the construction and operation. Alternatively, the discontinuous discharge device 336 may be replaced by a rotary air lock located at the upper end of the device 328, which enables tobacco to be discharged continuously or discontinuously from the feed pipe 338 to the chamber 330, without breaking the internal vacuum of the discharge device. In this alternative, the chamber 330 is at atmospheric pressure. A further alternative is to feed cut tobacco manually or by a simple conveyor to the wide chamber 330.

The feed of tobacco to the chamber 330, either on a discontinuous or continuous basis, using the devices described above, results in the provision of a reservoir of tobacco 344 in the reservoir chamber 330.

A separate tobacco separation and discharge device 346 is provided at the upper end of the reservoir device 328 in communication with the narrow chamber 332 for receiving a recycle feed of tobacco trimmed from the filler rod 14 by the trimmer device 322. The recycle of trimmed tobacco is effected in the illustrated embodiment by air drawn through recycle line 348. Any other convenient feed means may be employed, for example, a conveyor.

In the separation and discharge device 346, which is in the form of a cyclone separator in the illustrated embodiment, tobacco is separated from the conveying air stream and is continuously discharged to the hopper or chamber 332 by a rotary air lock 350 which maintains the vacuum conditions within the device 346 while permitting the tobacco to be discharged to the ambient atmospheric pressure conditions of the chamber 332. Depending on the manner of provision of the conveying air stream in line 348, the rotary air lock 350 may be omitted. Any other suitable separation and tobacco discharge device may be used.

Since tobacco is continuously trimmed from the filler rod 314 by the trimmer 322, and, as described below, the quantity of trimmed tobacco in the chamber 332 is employed as the control parameter, as a practical consideration, the recycle of trimmed tobacco and its discharge to the narrow chamber 332 should be effected continuously, as illustrated.

The recycled trimmed tobacco discharged to the narrow chamber 332 forms a reservoir of tobacco 352 in the narrow chamber 332. Sensors 353 and 354 are provided in association with the narrow chamber 332 to sense "too-high" and "too-low" conditions respectively of the tobacco in the reservoir 352. The tobacco reservoir 352 in the narrow chamber 332 and the tobacco reservoir 344 in the wide chamber 330 provide the sources of tobacco from which the tobacco carpet 326 is formed on the conveyor 324.

At the lower end of the reservoir device 328, there is provided a tobacco metering and opening device 356, which comprises a pair of counter-rotating metering rollers 358 which extend across the width of the reservoir device 328 in communication with the tobacco reservoirs 344 and 352 in both of the chambers 330 and 332. The counter-rotating rollers 358 have a plurality of radially-directed pins 360 which cooperate with each other to meter a desired amount of tobacco from both the reservoirs 344 and 352 simultaneously. The rate of rotation of the pair of rollers 358 determines the amount of tobacco discharged from the reservoir device 328 to the conveyor 326. Since the metering rollers 358 extend across the whole width of the reservoir device 328 and meter tobacco from both chambers 330 and 332, the rate of feed of tobacco from the chambers 330 and 332 is the same per unit width.

The tobacco metering and opening device 356 also includes a third roller 362 generally equidistantly positioned with respect to the pair of rollers 358. The third roller 362 is provided with projecting pins 364 which interdigitate with and cooperate with the pins 360 on the rollers 358 to separate the tobacco metered by the pair of rollers 358 from the reservoirs or sources 344 and 352 into individual tobacco particles which are discharged onto the upper surface of the conveyor 324 to provide the tobacco carpet 326.

The thickness of the carpet 326 on the conveyor 324 and hence the amount of tobacco forming the tobacco shower 320 from which the filler rod 314 is formed is determined by the speed of the conveyor surface 324 and the rate of rotation of the pair of rollers 358. Usually, the speed of the conveyor 324 is maintained constant and the tobacco flow rate then is controlled by the operation of the metering and opening device 356.

As may be seen from the foregoing description, the only tobacco recycled in this system is trimmed tobacco and no refuser mechanism is required or utilized. The tobacco which forms the carpet 326 is positively metered and then discharged in an opened condition from the reservoir device 328 by the tobacco metering and opening device 356 and is in the amount required for rod formation. Tobacco degradation introduced by refuser and metering mechanisms such as are employed in conventional cigarette-making machines is eliminated. The utilization of the hopper 328 not only enables fully- opened relatively-undamaged tobacco to be fed to rod formation but also results in considerable simplification in the elements of construction of a cigarette-making machine.

In this embodiment of the present invention, the recycle of trimmed tobacco by line 348 is used to control the operation of the rod-forming device 312. The rate of feed of tobacco by the metering and opening device 356 from the chambers 330 and 332 is controlled so as to maintain a substantially constant level of the tobacco 352 in the narrow chamber 332.

If the quantity of tobacco in the narrow chamber 332 rises, then the quantity of tobacco being trimmed has risen and, therefore, the cigarette-making machine is operating with an excess of the tobacco required. In response to a rise in the quantity of tobacco in the narrow chamber 332, the feed rate of tobacco from the reservoir device 328 is decreased by slowing down the rate of operation of the metering and opening device 356 until the desired level of recycled tobacco in the narrow chamber 332 is restored.

Similarly, if the quantity of tobacco in the narrow chamber 332 falls, then the quantity of tobacco being trimmed has fallen and, therefore, the cigarette-making machine is operating with a deficiency of tobacco. The feed rate of tobacco from the reservoir device 328 is speeded up to compensate for the inadequate feed rate until the desired level of recycled tobacco in the narrow chamber is restored.

The level of tobacco in the narrow chamber 332 may be sensed in any desired manner, for example, by using optical sensors 353 and 354, and usually variations in tobacco level within a predetermined range, as determined by the spacing of the sensors 353 and 354, are permitted. Through appropriate circuitry, a "too-high" or "too-low" signal may be used to trigger appropriate variation in the speed control 365 for the drive motor 366 for the device 356, which appropriately speeds up or slows down the rate of tobacco feed from the reservoirs 344 and 352.

Using the level of recycled tobacco in the narrow chamber 332 to control the rate of metered tobacco supplied to the rod-forming operation to ensure that the correct quantity of tobacco is present in the filler rod 314, is a very simple yet extremely functional operation. Overfeeding and trimming are required to be effected in cigarette filler rod formation for the reasons discussed above and it is necessary to recycle the trimmed tobacco to ensure economic use of tobacco. This embodiment of the present invention has used these prior art operations in a unique and useful manner, to control the rod-forming operation.

The recycle of trimmed tobacco also has been uniquely combined into a procedure of forming the feed to filler rod formation which does not involve any refuser mechanism and/or recycle procedure, other than the recycle of trimmed tobacco, thereby eliminating the tobacco degradation which results during conventional feed-forming procedures.

The degree of trimming of tobacco from the filler rod 314 also may be controlled, in accordance with one aspect of this embodiment of the invention. The degree to which trimming of a filler rod 314 is required to be effected to remove the variations in tobacco thickness along the length of the rod depends on a number of factors, including the nature of the rod-forming operation.

The degree of trimming is controlled by the width of the narrow chamber 332. As the transverse dimension of the chamber 332 is narrowed, less tobacco is required to maintain the desired level of tobacco 352 in the narrow chamber 332 and hence a lesser amount of tobacco needs to be recycled by line 348. Similarly, as the transverse dimension of the chamber 332 is widened, more tobacco is needed to maintain the desired level of tobacco 352 in the narrow chamber 332 and hence a greater amount of tobacco is required to be recycled by line 348.

The width of chamber 332, therefore, is preset to the desired degree of trimming having regard to the predetermined speed of operation of the cigarette rod-forming procedure and then that degree of trimming is maintained by maintaining the predetermined level of recycled trimmed tobacco 352 in the narrow chamber 332.

In FIG. 5, the trimmed tobacco is positioned adjacent the rod-forming surface of the wheel 316. It is also possible and preferred to arrange the apparatus 310 to provide the recycled trimmed tobacco on the exterior surface of the filler rod 314 and hence on the side of the filler rod opposite to the rod-forming surface of the wheel 316. In this way, the already-trimmed tobacco once again is trimmed and overall tobacco degradation thereby is minimized and an improved distribution of shorts across the width of the filler rod is achieved, since the increased quantity of shorts in the trimmed tobacco offsets the normal concentration of shorts towards the rod-forming surface.

Figure 6:
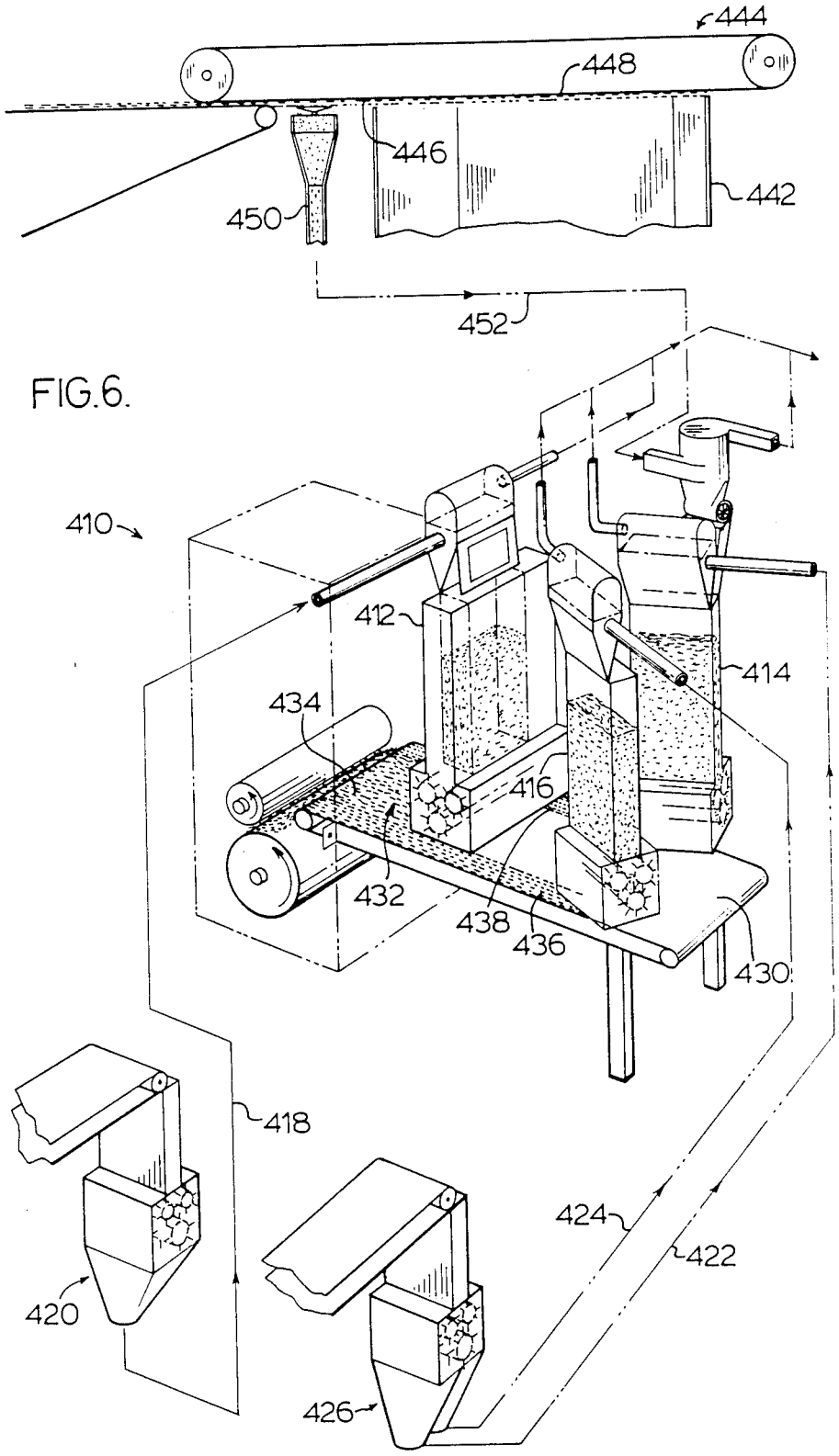
FIG. 6 is a schematic representation of one embodiment of the application of the present invention to the formation of composite cigarettes.

Referring to FIG. 6, there is illustrated the application of the principles of the present invention to the formation of composite cigarettes wherein an annulus of higher quality smoking material surrounds a core of lesser quality smoking material. The annulus smoking material generally is a cut tobacco blend from which cigarettes conventionally are formed while the core smoking material may comprise a cut tobacco blend of lesser smoking quality, processed stem or stalk, reconstituted or substitute tobacco. The rationale for a composite cigarette is discussed in copending U.S. patent application Ser. No. 06/862,981 referred to above.

As seen in FIG. 6, a filler rod-forming apparatus 410 comprises three separate reservoirs 412, 414 and 416. The reservoir 412 receives core tobacco by line 418 from a tobacco storing, metering and opening device 420, while the reservoirs 414 and 416 are fed by lines 422 and 424 respectively, typically by air conveying, from an additional tobacco storing, metering and opening device 426, constructed to provide two separate tobacco feeds. The device 420 may be constructed as described in detail in U.S. Pat. No. 4,459,999 referred to above while the device 426 may be constructed as described in the aforementioned U.S. Pat. No. 4,135,615. Alternatively, tobacco may be fed by lines 418, 420 and 424 to the respective reservoirs 412, 414 and 416 from a tobacco feeding table of any other convenient construction. The core and annulus tobacco material may be discharged to the respective reservoirs 412, 414 and 416 in any desired manner, continuously or discontinuously.

From each of the reservoirs 412, 414 and 416, tobacco is metered onto a conveyor 430 to form a carpet 432 of tobacco containing a central region 434 of core tobacco and two outer regions 436 and 438 of annulus tobacco. The tobacco carpet 432 may be fed onto the lower one of a pair of carding drums 440, thence to form an upwardly-flowing tobacco stream in a chimney 442 of a rod-former 444, as described above with respect to FIG. 2. The carding drums 440 are operated simply as transport devices, also as described in detail above with respect to FIG. 2.

A tobacco filler rod 446 is formed on a suction band 448, comprising an upper layer of annulus material, an intermediate layer of core material and a lower layer of annulus material. The filler rod 446 is trimmed to remove excess tobacco by a trimmer 450. Trimmed tobacco is recycled by line 452 to the reservoir 414. A cigarette rod then is formed from the trimmed rod in conventional manner.

By recycling the trimmed tobacco to the reservoir 414, the trimmed tobacco forms part of the tobacco in the lower layer of the filler rod 446, so that the tobacco which is trimmed includes previously trimmed tobacco, which decreases the degradation resulting from trimming. Further, by providing the recycled trimmed tobacco as part of the lower layer, the distribution of shorts over the cross-section of the filler rod 446 is improved, as discussed above. However, trimmed tobacco may be recycled to reservoir 416, if desired.

As is described in the aforementioned copending U.S. patent application Ser. No. 06/862,981, the trimming procedure may be modified to provide an increased proportion of annulus smoking material at the lighting end of cigarettes formed from the filler rod, for the reasons discussed therein.

The provision of the individual reservoirs 412,414 and 416 to provide the respective feeds is but one manner of providing the feeds. One alternative is to provide a single reservoir which is divided by internal upright baffles into a wide central chamber for core material and two peripheral narrow chambers for annulus material with a common set of metering and opening rollers feeding material from the three chambers. Another alternative is to provide two reservoirs, one for core material and the other having two separate chambers for annulus material.

SUMMARY OF DISCLOSURE

In summary of this disclosure, the present invention provides novel methods and apparatus for improved cigarette filler rod formation by avoiding tobacco degradation procedures. Modifications are possible within the scope of this invention.

What we claim is:

1. A method of forming a tobacco filler rod suitable for the formation of cigarettes, which comprises:

providing a metered flow of cut tobacco particles by metering cut tobacco from a source thereof and opening said metered cut tobacco to separate the individual tobacco particles one from another, forming a wide stream of tobacco particles from the individual separated tobacco particles and transporting said wide stream to provide feed to the formation of a vertically-moving shower, forming a vertically-moving shower of cut tobacco particles from said feed, and forming a filler rod from said shower, all the cut tobacco metered from said source thereof and opened to separate the individual particles one from another being used to form said wide stream and all the individual separated tobacco particles in said wide stream being transported to provide said feed.

2. The method of claim 1 wherein said source of tobacco is located in an upright tobacco reservoir zone having a tobacco receiving upper inlet and a lower outlet from which the cut tobacco is metered.

3. In a method of forming a tobacco filler rod suitable for the formation of cigarettes, wherein a vertically-moving shower of cut tobacco particles is formed from a metered flow thereof and said filler rod is formed from said shower, the improvement wherein:

said metered flow of cut tobacco particles is provided by metering cut tobacco from a source thereof and opening said metered cut tobacco to separate the individual tobacco particles one from another, a wide stream of tobacco particles is formed from the individual separated tobacco particles and is transported to provide feed to the vertically-moving shower, and clumps of tobacco in said wide stream are sensed and are opened without affecting the remainder of the tobacco in the wide stream.

4. In a method of forming a tobacco filler rod suitable for the formation of cigarettes wherein a vertically-moving shower of cut tobacco particles is formed from a metered flow thereof and said filler rod is formed from said shower, the improvement wherein:

said metered flow of cut tobacco particles is provided by metering cut tobacco from a source thereof located in an upright tobacco reservoir zone having a generally rectangular cross section, a tobacco receiving upper inlet and a lower outlet from which the cut tobacco is metered and opening said metered cut tobacco to separate the individual tobacco particles one from another, said metering is effected by a pair of counter-rotating rollers having pins extending from the surfaces thereof so as to meter tobacco from the outlet, said opening is effected by a third roller having pins extending from the surface thereof, so as to interact with the pairs of the cooperating pair of rollers to open tobacco metered by the cooperating pair of rollers, and a wide stream of tobacco particles is formed from the individual separated tobacco particles and is transported to provide feed to the vertically-moving shower.

5. The method of claim 4 wherein the wide stream of tobacco particles is formed by discharging the opened tobacco onto a moving surface which also transports the wide stream towards vertically-moving shower formation.

6. In a method of forming a tobacco filler rod suitable for the formation of cigarettes, wherein a vertically-moving shower of cut tobacco particles is formed from a metered flow thereof and said filler rod is formed from said shower, the improvement wherein:

said metered flow of cut tobacco particles is provided by metering cut tobacco from a source thereof located in an upright tobacco reservoir zone having a tobacco receiving upper inlet and a lower outlet from which the cut tobacco is metered, said reservoir zone is divided into a narrow upright chamber and a wider upright chamber, tobacco is trimmed from the filler rod and is recycled to the narrow chamber, and tobacco is metered from the two chambers at the same rate, and a wide stream of tobacco particles is formed from the individual separated tobacco particles and is transported to provide feed to the vertically-moving shower.

7. In a method of forming a tobacco filler rod suitable for the formation of cigarettes, wherein a vertically-moving shower of cut tobacco particles is formed from a metered flow thereof and said filler rod is formed from said shower, the improvement wherein:

said metered flow of cut tobacco particles is provided by metering cut tobacco from a source thereof and opening said metered cut tobacco to separate the individual tobacco particles one from another, and a wide stream of tobacco particles is formed from the individual separated tobacco particles and is transported to provide feed to the vertically-moving shower, said wide stream of tobacco particles comprising a central broad band of smoking material of lesser smoking quality and two narrow outer bands of smoking material of greater smoking quality, whereby said filler rod comprises a layer of smoking material of lesser smoking quality sandwiched between upper and lower layers of smoking material of greater smoking quality and, upon subsequent enclosure in a wrapper, there is formed a composite cigarette comprising a core of the smoking material of lesser smoking quality enclosed within an annulus of the smoking material of greater quality smoking material.

8. A cigarette-making machine, comprising:

an upright hopper containing cut tobacco and having an upper inlet and a lower outlet, a pair of tobacco metering rollers located in communication with the hopper outlet for metering cut tobacco therefrom and a tobacco opening roller in operative relation to the pair of metering rollers to separate tobacco particles in said metered flow one from another, conveyor means for receiving said opened tobacco thereon and transportation as a wide stream of tobacco particles, and tobacco shower-forming means for forming a vertically-moving shower of tobacco particles from said wide stream of tobacco particles.

9. The cigarette-making machine of claim 8 wherein said hopper comprises a generally rectangularly cross-sectioned vessel.

10. The cigarette-making machine of claim 9 wherein said vessel has an upwardly-extending baffle dividing the interior of the vessel into a narrow chamber for receipt of recycled trimmed tobacco and a wide chamber.

11. The cigarette-making machine of claim 8 wherein said hopper is constituted by three chambers comprising a central chamber containing a lesser quality smoking material and two outer chambers containing a higher quality smoking material, whereby said wide stream contains a central band of said lesser quality smoking material and two outer bands of said higher quality smoking material.

12. The cigarette-making machine of claim 11 wherein said chambers are provided in separate reservoir vessels.

13. The cigarette-making machine of claim 11 wherein said chambers are provided in the same reservoir vessel.

14. The cigarette-making machine of claim 8 including sensing means for sensing and opening clumps of tobacco present in said wide stream of tobacco particles, without adversely affecting the remainder of the tobacco in the wide stream.

15. The cigarette-making machine of claim 14, wherein said sensing means comprises a pair of counter-rotating upper and lower carding drums which are spaced apart to enable the wide stream of tobacco particles to be transported by the lower one of the carding drums without engagement by the upper one except for any clumps of tobacco in the wide stream.

16. The cigarette-making machine of claim 8 wherein said conveyor means includes a single carding drum.

17. The cigarette-making machine of claim 16, wherein a second carding drum is positioned adjacent to but spaced from said single carding drum so as to be in cooperative relationship to engage and open any clumps of tobacco in said wide stream of tobacco particles as it is transported on said single carding drum without affecting the remainder of the tobacco particles in said wide stream.

18. The method of claim 1 wherein said transportation of said wide stream includes transportation on the external surface of a rotary tobacco-conveying device.

19. The method of claim 2 wherein said transportation of said wide stream includes transportation on the external surface of a rotary tobacco-conveying device, and said clumps of tobacco are sensed and opened while said wide stream is transported on the external surface of the rotary tobacco-conveying device by a counter-rotating rotary tobacco-refuser device which is spaced from the periphery of said rotary tobacco-conveying device a distance which permits said clumps of tobacco to be engaged and opened by said rotary tobacco-refuser device without engaging the remainder of the tobacco in said wide stream.

20. The method of claim 4 wherein said transportation of said wide stream includes transportation on the external surface of a rotary tobacco-conveying device.

* * * * *